US007885589B2

(12) United States Patent
Fukuyama et al.

(10) Patent No.: US 7,885,589 B2
(45) Date of Patent: Feb. 8, 2011

(54) IMAGE FORMING DEVICE AND IMAGE FORMING DEVICE CONTROL METHOD

(75) Inventors: Hirotaka Fukuyama, Shizuoka-ken (JP); Koichiro Sato, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/488,683

(22) Filed: Jun. 22, 2009

(65) Prior Publication Data

US 2009/0257765 A1 Oct. 15, 2009

Related U.S. Application Data

(63) Continuation of application No. 11/743,232, filed on May 2, 2007, now Pat. No. 7,570,908.

(30) Foreign Application Priority Data

May 9, 2006 (JP) ..... 2006-129840

(51) Int. Cl.
*G03G 15/01* (2006.01)

(52) U.S. Cl. ..... 399/302; 399/308

(58) Field of Classification Search ..... 399/38, 399/50, 53, 55, 56, 302, 308
See application file for complete search history.

(56) References Cited

U.S. PATENT DOCUMENTS 6,314,264 B1 11/2001 Iida et al.
6,697,581 B2 2/2004 Ohtani et al.
6,985,681 B2 1/2006 Taguchi et al.
7,308,223 B2 * 12/2007 Kurosu ..... 399/267

FOREIGN PATENT DOCUMENTS

JP 2000-075670 3/2000

* cited by examiner

*Primary Examiner*—Hoan Tran
(74) *Attorney, Agent, or Firm*—Turocy & Watson, LLP

(57) ABSTRACT

A technique capable of preventing deterioration of image quality resulting from a band-shaped toner image created on a photosensitive surface in order to prevent so-called carrier attraction is provided. An image forming method involving an abutting and separation step that allows a first image carrier (YMC) and a second image carrier (K) to abut on an intermediate transfer body to form an image and thereafter that allows only the second image carrier to abut on the intermediate transfer body by separating the first image carrier from the intermediate transfer body; and then a collecting step that collects a toner band on the first image carrier in situ to conduct new image formation.

9 Claims, 8 Drawing Sheets

ON STAND-BY AND IMMEDIATELY AFTER ACTIVATION

AT PRINTING

TONER BAND AVOIDING TIMING AT ACTIVATION

TONER BAND AVOIDING TIMING AT STOPPAGE

ON STAND-BY AND IMMEDIATELY AF TER ACTIVATION

AT PRINTING

TONER BAND AVOIDING TIMING AT ACTIVATION

TONER BAND AVOIDING TIMING AT STOPPAGE

ON STAND-BY AND IMMEDIATELY AFTER ACTIVATION

TONER BAND AVOIDING TIMING AT STOPPAGE AT PREVIOUS TIME

TONER BAND PASSING TIMING AT ACTIVATION

AT PRINTING

TONER BAND AVOIDING TIMING AT STOPPAGE

ON STAND-BY

"PRIOR ART"

IMAGE FORMING DEVICE AND IMAGE FORMING DEVICE CONTROL METHOD

CROSS-REFERENCE TO RELATED APPLICATIONS

This application claims the benefit of priority from and is a Continuation of application Ser. No. 11/743,232 filed on May 2, 2007, which claims the benefit of priority from Japanese patent application No. 2006-129840 filed on May 9, 2006, the entire contents of both of which are incorporated herein by reference.

BACKGROUND OF THE INVENTION

1. Field of the Invention

The present invention relates to an image forming device and image forming device control method for carrying out image forming on a sheet of paper with two-component developer by using an intermediate transfer body. In particular, the present invention relates to a technique for preventing developer from adhering to a transfer roller which presses a sheet of paper to the intermediate transfer body.

2. Description of the Related Art

There is conventionally known a technique for preventing generation of so-called "carrier attraction" in an image forming device for carrying out image forming on a sheet of paper with two-component developer including toner and carrier. In the technique, application of a predetermined potential difference to a surface of a photoreceptor by a developing device is started before processing of electrification of the surface of the photoreceptor by a charger, and the application of the predetermined potential difference to the surface of the photoreceptor by the developing device is completed after the processing of electrification of the surface of the photoreceptor by the charger is completed (a region to be electrified by the charger is positioned at an inner side of a region to which the predetermined potential difference is applied by the developing device in order to develop an electrostatic latent image to be formed in the region with the two-component developer). Accordingly, a region in which an electric field in a developing direction is created outside the region to which the processing of the electrification is applied on the surface of the photoreceptor, and a band-shaped toner image (also called a toner band) is formed intentionally.

FIG. 8 is a view showing temporal changes of the potential on the surface of the photoreceptor and the potential applied by the developing device viewed from a developing position at the time of image forming in the conventional image forming device including a mechanism for preventing generation of the carrier attraction. In FIG. 8, a shaded part is a part of the "band-shaped toner image" described above.

In the conventional image forming device, the band-shaped toner image is intentionally formed as described above. Thus, generation of a scratch on the surface of the photoreceptor due to the "carrier attraction" has been restricted to maintain image quality.

In a case of an image forming device of a so-called direct transfer system in which a toner image is formed on a surface of a photoreceptor and the toner image on the photoreceptor is directly transferred on a sheet of paper supported by an intermediate transfer body, there has not been a case where the "band-shaped toner image" formed by the conventional image forming device described above appears as a stain on an image.

However, in an image forming device with a configuration in which a toner image formed on a surface of a photoreceptor is temporarily supported by an intermediate transfer body, and then the toner image on the intermediate transfer body is transferred to a sheet of paper to be conveyed by pressing the sheet of paper to the intermediate transfer body by a transfer roller, there has been a case where toner of the "band-shaped toner image" described above adheres to a roller surface of the transfer roller. The wasteful toner adhered to the transfer roller as described above is adhered to the sheet of paper when the sheet of paper is pressed to the intermediate transfer body, and may cause deterioration in image quality.

SUMMARY OF THE INVENTION

An object of embodiments of the present invention is to provide a technique capable of preventing deterioration of image quality resulting from the band-shaped toner image generated on a photosensitive surface in order to prevent so-called carrier attraction.

In order to achieve the above object, according to an aspect of the present invention, there is provided an image forming device in which, on a photosensitive surface of a photoreceptor, a first region electrified by a charger is set to be positioned at an inner side of a second region to which a predetermined potential difference is applied by a developing device in order to develop an electrostatic latent image formed in the first region with two-component developer, the device comprising: an intermediate transfer body that is arranged to be capable of abutting and being separated from the photosensitive surface, and has an image developed by the two-component developer transferred thereon from the photosensitive surface at a predetermined transfer position; and an abutting and separation controlling unit that separates the intermediate transfer body from the photoreceptor when a region of the second region excluding the first region on the photosensitive surface passes the predetermined transfer position.

In addition, according to an aspect of the present invention, there is provided an image forming device in which, on a photosensitive surface of a photoreceptor, a first region electrified by a charger is set to be positioned at an inner side of a second region to which a predetermined potential difference is applied by a developing device in order to develop an electrostatic latent image formed in the first region with two-component developer, the device comprising: an intermediate transfer body that is arranged to be capable of abutting and being separated from the photosensitive surface, and has an image developed by the two-component developer transferred thereon from the photosensitive surface at a predetermined transfer position; a transfer roller that presses a sheet of paper to the intermediate transfer body at a predetermined secondary transfer position when the image developed by the two-component developer and transferred on the intermediate transfer body is transferred on the sheet of paper; and an abutting and separation controlling unit that separates the transfer roller from the intermediate transfer body when an image corresponding to a region of the second region excluding the first region in the image transferred on the intermediate transfer body passes the predetermined secondary transfer position.

In addition, according to an aspect of the present invention, there is provided an image forming device control method in which, on a photosensitive surface of a photoreceptor, a first region electrified by a charger is set to be positioned at an inner side of a second region to which a predetermined potential difference is applied by a developing device in order to develop an electrostatic latent image formed in the first region with two-component developer, the method comprising: an intermediate transfer step that transfers an image developed by the two-component developer from the photosensitive surface to an intermediate transfer body at a predetermined transfer position by using the intermediate transfer body arranged to be capable of abutting and being separated from the photosensitive surface; and an abutting and separation controlling step that separates the intermediate transfer body from the photoreceptor when a region of the second region excluding the first region on the photosensitive surface passes the predetermined transfer position.

DETAILED DESCRIPTION OF THE PREFERRED EMBODIMENTS

Hereinafter, embodiments of the present invention will be described with reference to the accompanying drawings.

First Embodiment

Figure 1:
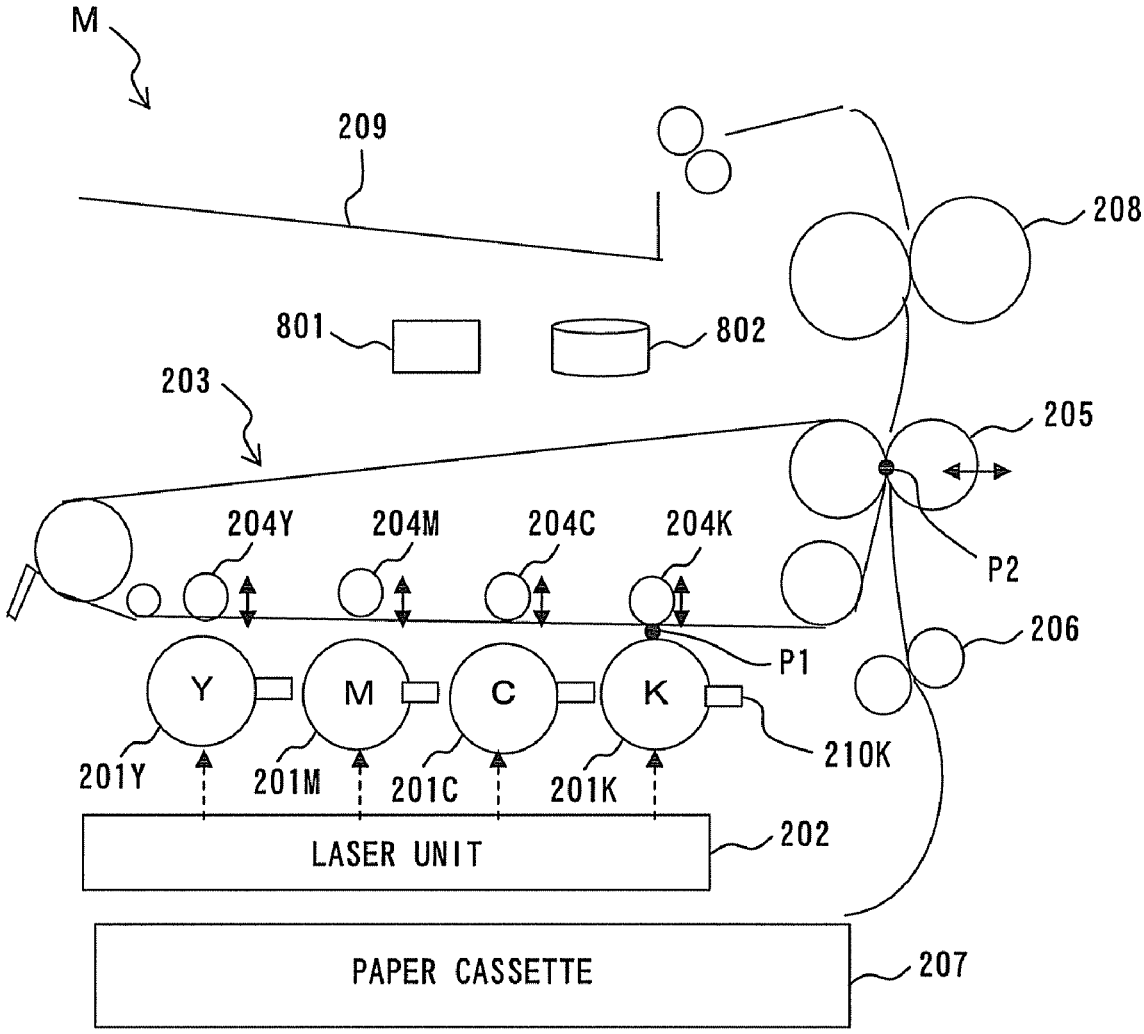
FIG. 1 is an entire configuration diagram showing an outline of a device configuration of an image forming device M according to a first embodiment of the present invention.
Figure 2:
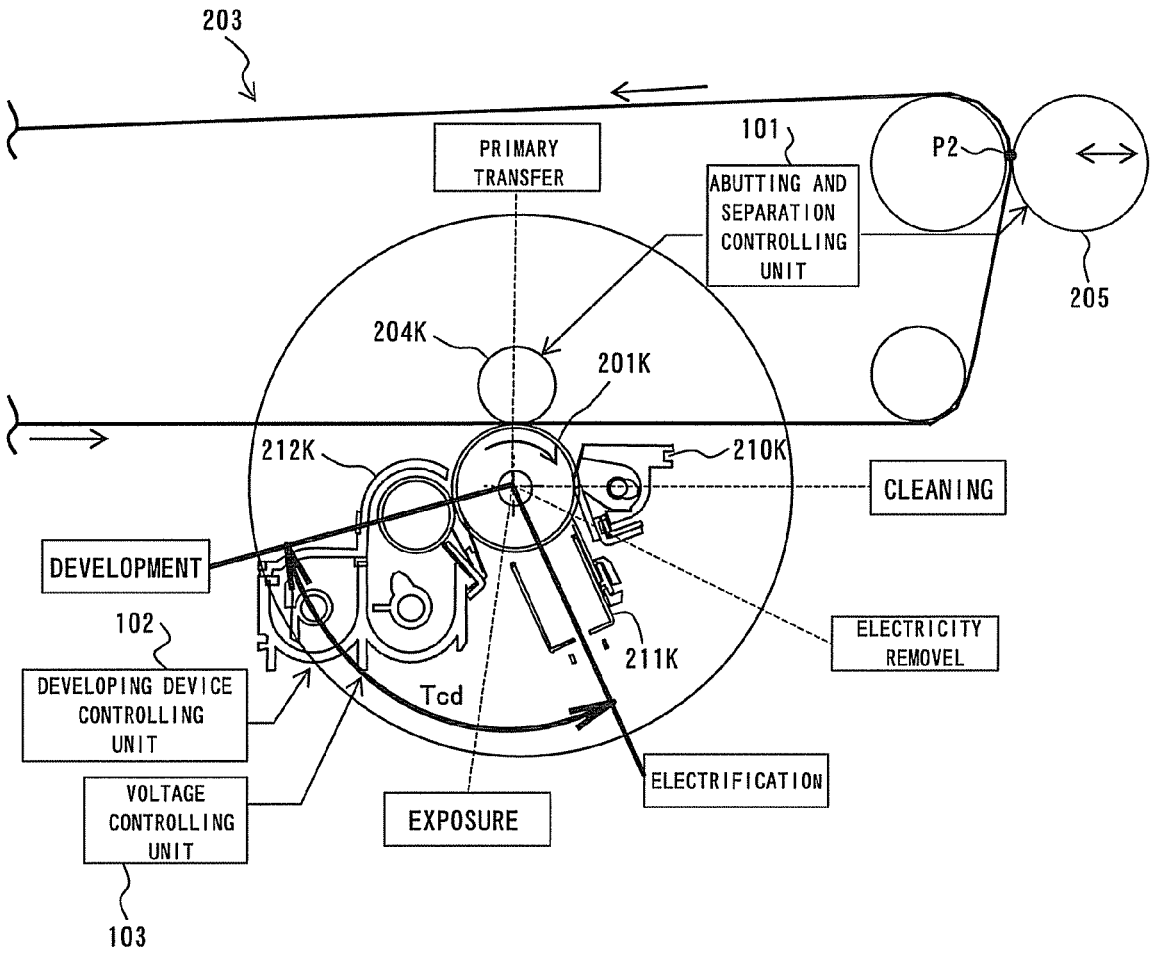
FIG. 2 is a view for explaining a detailed configuration and operation at a periphery of a photoreceptor 201K for black toner in the image forming device M.

Hereinafter, a first embodiment of the present invention will be described with reference to the accompanying drawings. FIG. 1 is an entire configuration diagram showing an outline of a device configuration of an image forming device M according to the present embodiment. FIG. 2 is a view for explaining a detailed configuration and operation at a periphery of a photoreceptor 201K for black toner in the image forming device M.

As shown in FIGS. 1 and 2, the image forming device M according to the present embodiment is an image forming device of a so-called quadruple tandem system, and configured to include photoreceptors 201Y to 201K, a laser unit 202, an intermediate transfer belt (intermediate transfer body) 203, primary transfer rollers 204Y to 204K, a secondary transfer roller (transfer roller) 205, a resist roller 206, a paper cassette 207, a fixing unit 208, a paper discharging tray 209, an abutting and separation controlling unit 101, a developing device controlling unit 102, a voltage controlling unit 103, a CPU 801, and a MEMORY 802. The CPU 801 has a role of carrying out a variety of types of processing in the image forming device M. Also, the CPU 801 has a role of achieving a variety of functions by executing a program stored in the MEMORY 802. The MEMORY 802 is configured with, for example, a ROM, a RAM, etc. and has a role of storing a variety of types of information and programs used in the image forming device M.

Here, the abutting and separation controlling unit 101 has a role of controlling operation of abutting and separation between the intermediate transfer belt 203 and the photoreceptors 201Y to 201K. In addition, the developing device controlling unit 102 has a role of controlling toner supplying operation in a developing device (rotational drive of a magnet roller incorporated in the developing device, etc.) arranged along a photosensitive surface of each of the photoreceptors 201Y to 201K. In addition, the voltage controlling unit 103 has a role of controlling so-called transfer bias applied between the secondary transfer roller 205 and the transfer belt 203.

Hereinafter, a simple flow of image forming processing to a sheet of paper in the image forming device M according to the present embodiment will be described. Here, for the convenience of understanding, only the photoreceptor 201K will be described with respect to detailed operation around the photoreceptors. However, such operation is similar as to the other photoreceptors 201Y to 201C.

When the image forming processing starts, the photosensitive surface of the photoreceptor 201K which has started rotation is cleaned by a cleaner 201K first. Next, electrification processing of the photosensitive surface of the photoreceptor 201K is carried out by a charger 211K after electricity removal processing of the photosensitive surface is carried out. Subsequently, the laser unit 202 carries out exposure processing to a region to which the electrification processing is applied on the photosensitive surface of the photoreceptor 201K based on image data in order to form an electrostatic latent image on the photosensitive surface. Then, the electrostatic latent image described above is developed with two-component developer including toner and carrier in a developing device 212K.

The intermediate transfer belt (intermediate transfer body) 203 is capable of abutting and being separated from the photoreceptor 201K by movement of the primary transfer roller 204. A toner image formed on the photoreceptor 201K as described above is transferred to a belt surface from the photosensitive surface at a predetermined transfer position P1 when the intermediate transfer belt 203 abuts on the photoreceptor 201K.

The toner image of each color transferred on the intermediate transfer belt 203 in the manner described above is transferred to a sheet of paper pressed to a belt surface of the intermediate transfer belt 203 at a predetermined secondary transfer position P2 by the secondary transfer roller 205 arranged to be capable of abutting and being separated from the belt surface.

The sheet of paper on which the toner image is transferred has the toner image fixed thereon by being heated in the fixing unit 208, is discharged to the paper discharging tray 209, and the processing is completed.

Figure 3:
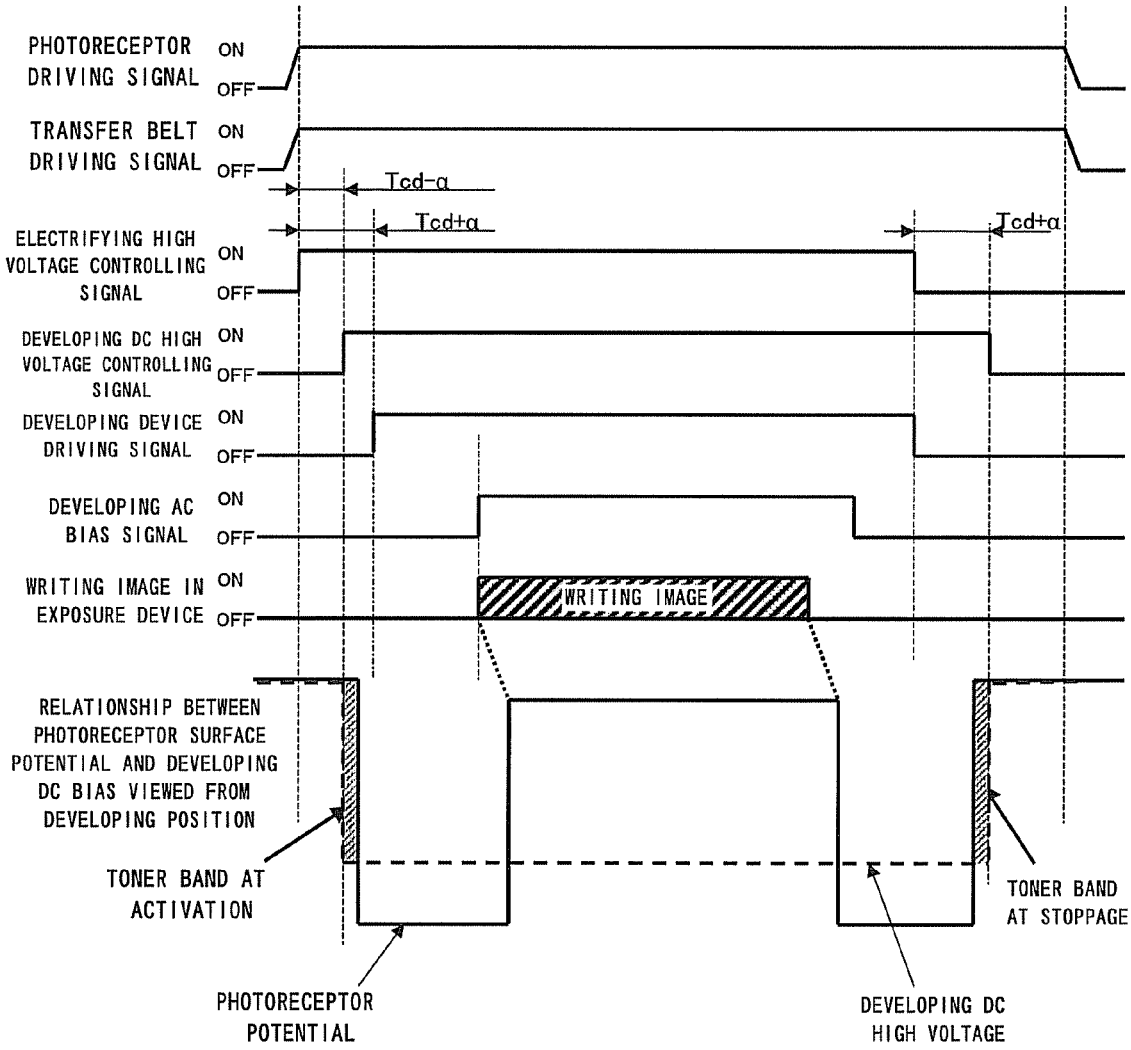
FIG. 3 is a timing chart showing an on/off timing of a drive signal and a control signal in the image forming device M according to the first embodiment of the present invention.

FIG. 3 is a timing chart showing an on/off timing of a drive signal and a control signal in the image forming device M according to the present embodiment. In the image forming device M according to the present embodiment, rotational drive of the photoreceptors and drive of the intermediate transfer belt 203 start before the electrification processing (so-called electrifying high voltage) by the charger starts. The electrification processing by the charger starts at a timing where rotation of the photoreceptor is stabilized.

A timing of applying a predetermined potential difference for developing processing in the developing device (so-called developing high voltage) is a timing before a moving time Tcd from start of the electrifying processing of the photosensitive surface of the photoreceptor to a developing position (refer to FIG. 2) for a margin distance equivalent time (α). In addition, start of operation of supplying toner in the developing device (rotational drive of a magnet roller incorporated in the developing device, etc.) is in a timing delayed from the moving time Tcd from the start of the electrifying processing of the photosensitive surface of the photoreceptor to the developing position by the margin distance equivalent time (α).

On the other hand, when the image forming processing is completed and operation is terminated, the operation of supplying toner in the developing device is terminated in sync with termination of the electrification processing by the charger. Application of a predetermined potential difference for developing processing in the developing device is completed by delaying from the moving time Tcd from the start of the electrification processing of the photosensitive surface of the photoreceptor to the developing position for the margin distance equivalent time (α). A band-shaped toner image is generated at the time of stoppage in a section of the margin distance equivalent time (α). Thereafter, rotational drive of the photoreceptor and transfer belt drive are turned off. As described above, the developing device controlling unit 102 stops supplying operation of the two-component developer in the developing device when the developing device applies a predetermined potential difference to a region between an upper stream side edge portion of a first region and an upper stream side edge portion of a second region in a moving direction of the photosensitive surface. In this manner, excess toner can be prevented from moving to a side of the photoreceptor in the section of the margin distance equivalent time (α) described above. Thus, density of the band-shaped toner image formed on the photosensitive surface can be reduced.

In the image forming device M according to the present invention, by carrying out the control described above, the first region electrified by the charger is positioned at an inner side of the second region to which the developing device applies a predetermined potential difference in order to develop an electrostatic latent image formed in the first region with the two-component developer, and carrier attraction can be prevented. A region of the second region excluding the first region on the photosensitive surface has a band-shaped toner image formed thereon.

Figure 4:
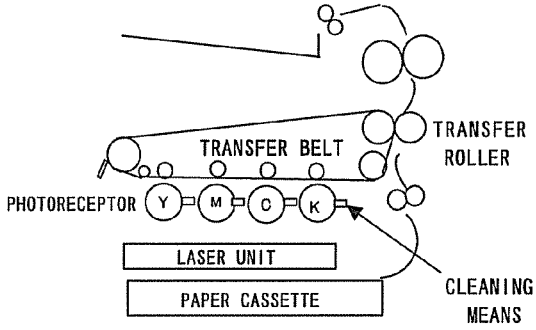
FIGS. 4(1) to 4(4) are views for explaining operation in the image forming device M according to the first embodiment of the present invention.
Figure 4:
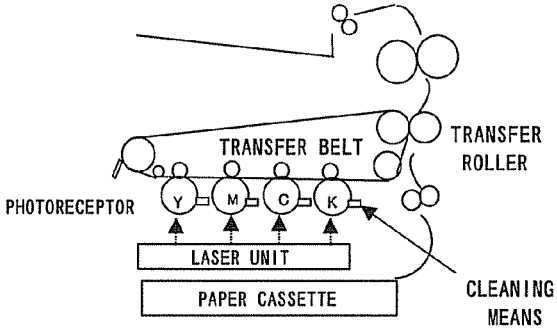
Figure 4:
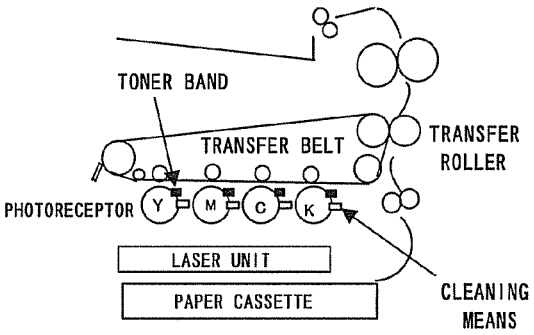
Figure 4:
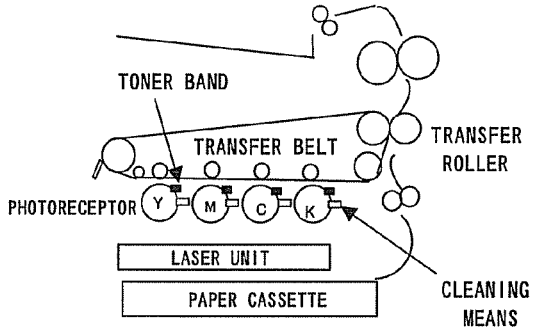

FIGS. 4(1) to 4(4) are views for explaining the operation in the image forming device M according to the first embodiment of the present invention. FIG. 4(1) shows a view on stand-by. FIG. 4(2) is a view showing a state where a band-shaped toner image formed on the photoreceptor at the start of the image forming processing is passing the primary transfer position P1 in a state where the photoreceptor and the intermediate transfer belt are separated from each other by the abutting and separation controlling unit 101. Thereafter, the photoreceptor and the transfer belt are made abutting each other by the abutting and separation controlling unit 101, and printing operation of FIG. 4(3) starts. At termination of the printing operation, the band-shaped toner image formed on the photoreceptor at the time of the termination of the image forming processing passes the primary transfer position P1 in a state where the photoreceptor and the transfer belt are separated from each other by the abutting and separation controlling unit 101. As described above, the abutting and separation controlling unit 101 separates the intermediate transfer belt from the photoreceptor when the region of the second region excluding the first region on the photosensitive surface passes the predetermined transfer position. By the above operation, a stain on an image due to the band-shaped toner image formed on the photoreceptor at the time of activating and stopping the image forming processing can be prevented.

In addition, in general, in a configuration of the image forming device according to the present embodiment, the band-shaped toner image created at termination of the image forming processing is known to be formed with higher density than the band-shaped toner image created on the photosensitive surface at start of the image forming processing. The abutting and separation controlling unit 101 is also capable of making the intermediate transfer belt separated from the photoreceptor when the region between the upper stream side edge portion of the second region and the upper stream side edge portion of the first region in the moving direction of the photosensitive surface passes the predetermined transfer position. In this manner, deterioration of image quality due to the band-shaped toner image formed with higher density on the photosensitive surface can at least be avoided, and the configuration can contribute to the improvement of image quality.

The abutting and separation controlling unit 101 obtains, for example, information regarding an electrifying high voltage timing with respect to the photoreceptor, a photoreceptor rotational speed, etc., from the CPU 801. The abutting and separation controlling unit 101 is configured to carry out judgment of a timing of separating the photoreceptor and the transfer belt based on the obtained information.

Second Embodiment

Next, a second embodiment of the present invention will be described. Since the present embodiment is a modification of the first embodiment described above, a basic device configuration thereof is the same. Hereinafter, parts which have a similar function as those corresponding parts described above are designated by the same reference numerals and a description thereof will be omitted.

Figure 5:
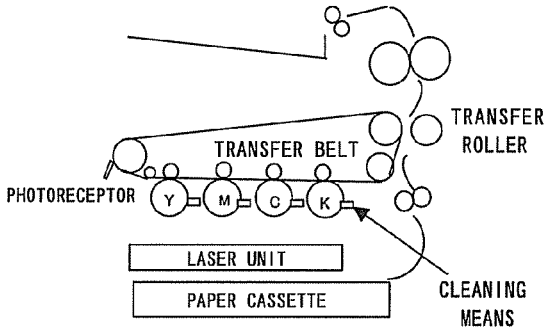
FIGS. 5(1) to 5(4) are views for explaining operation in the image forming device M according to a second embodiment of the present invention.
Figure 5:
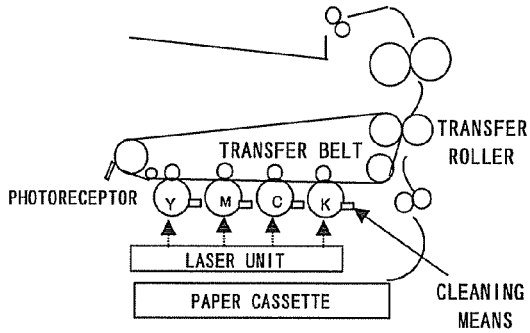
Figure 5:
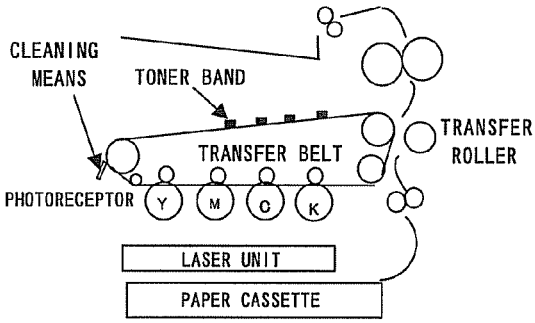
Figure 5:
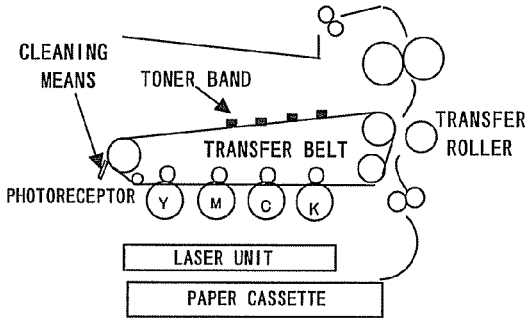

FIGS. 5(1) to 5(4) are views for explaining operation of the image forming device M according to the second embodiment of the present invention. FIG. 5(1) shows a view on stand-by. FIG. 5(2) is a view showing a state where a band-shaped toner image formed on the photoreceptor at the start of the image forming processing is passing a position of a transfer roller 205 (predetermined secondary transfer position P2) separated by the abutting and separation controlling unit 101. Thereafter, the abutting and separation controlling unit 101 makes the transfer belt abut the secondary transfer roller, and printing operation of FIG. 5(3) starts. At termination of the printing operation, as shown in FIG. 5(4), the band-shaped toner image formed on the photoreceptor at the time of the termination of the image forming processing passes the secondary transfer position P2 in a state where the transfer belt and the secondary transfer roller is separated by the abutting and separation controlling unit 101.

By carrying out the above operation, a stain on an image due to the band-shaped toner image formed on the photoreceptor at activation and stoppage of the image forming processing can be prevented. As described above, the abutting and separation controlling unit 101 can also make the transfer roller and the intermediate transfer belt separate from each other when an image corresponding to the region of the second region excluding the first region in the image transferred on the intermediate transfer belt passes the predetermined secondary transfer position.

In addition, in the present embodiment as well, the band-shaped toner image created at the termination of the image forming processing is formed to have higher density than the band-shaped toner image created on the photosensitive surface at the start of the image forming processing. Therefore, the abutting and separation controlling unit 101 is preferably configured to separate the transfer roller from the intermediate transfer belt 203 when an image corresponding to the region between the upper stream side edge portion of the second region and the upper stream side edge portion of the first region in the moving direction of the photosensitive surface in an image transferred on the intermediate transfer belt 203 passes the predetermined secondary transfer position P2. In this manner, deterioration of image quality due to the band-shaped toner image formed on the photosensitive surface with high density can at least be avoided, and the present embodiment can contribute to the improvement of image quality.

In addition, the developing device controlling unit 102 stops the supplying operation of the two-component developer in the developing device (rotation of the magnet roller, etc.) when the developing device applies a predetermined potential difference to the region between the upper stream side edge portion of the first region and the upper stream side edge portion of the second region in the moving direction of the photosensitive surface.

The abutting and separation controlling unit 101 obtains, for example, information regarding an electrifying high voltage timing with respect to the photoreceptor, a photoreceptor rotational speed, an intermediate transfer belt moving speed, etc., from the CPU 801 and carries out judgment of a timing of separating the intermediate transfer belt 203 and the secondary transfer roller 205 based on the obtained information. In addition, the developing device controlling unit 102 obtains, for example, information regarding an electrifying high voltage timing with respect to the photoreceptor, a photoreceptor rotational speed, etc., from the CPU 801 and carries out judgment of a timing of stopping operation of supplying toner in the developing device based on the obtained information.

Third Embodiment

Next, a third embodiment of the present invention will be described. Since the present embodiment is a modification of the embodiments described above, a basic device configuration thereof is the same. Hereinafter, parts which have a similar function as those corresponding parts described above are designated by the same reference numerals and a description thereof will be omitted.

Figure 6:
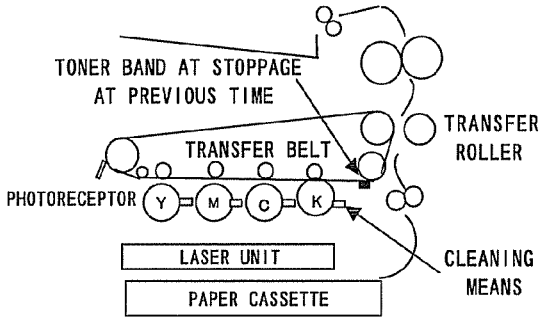
FIGS. 6(1) to 6(6) are views for explaining operation in the image forming device M according to a third embodiment of the present invention.
Figure 6:
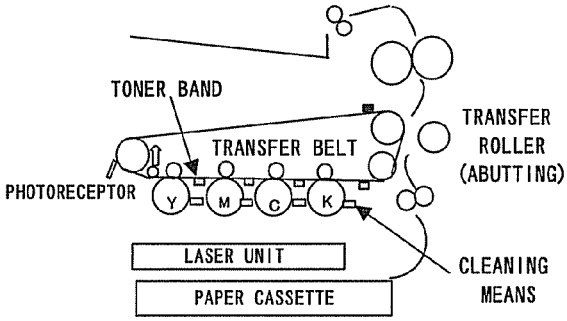
Figure 6:
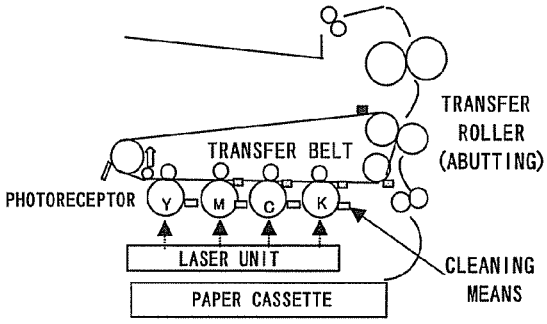
Figure 6:
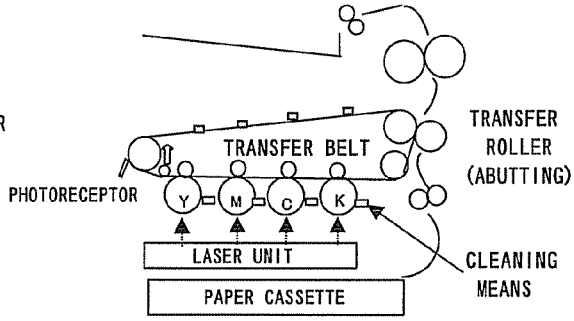
Figure 6:
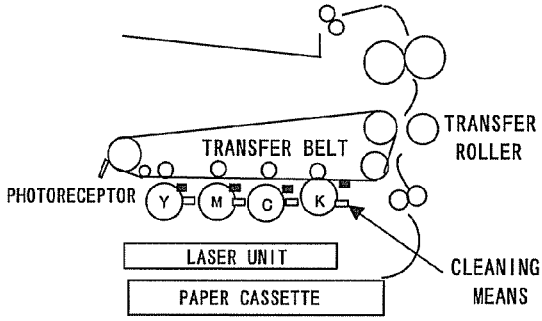
Figure 6:
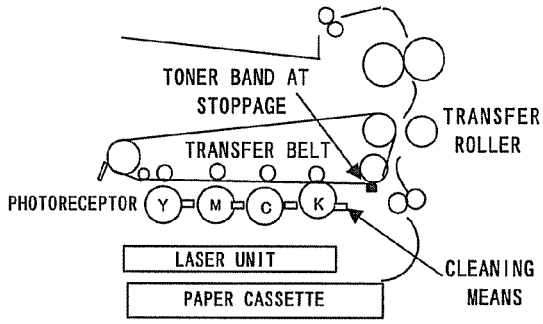

FIGS. 6(1) to 6(6) are views for explaining operation of the image forming device M according to the third embodiment of the present invention. FIG. 6(1) shows a view on stand-by. At this time, the photoreceptors of Y (yellow), M (magenta), and C (cyan) are separated from the intermediate transfer belt 203 and only the photoreceptor for black abuts on the intermediate transfer belt 203. FIGS. 6(2) and 6(3) show states where a band-shaped toner image formed on the photoreceptor at the start of the image forming processing is attached to the intermediate transfer belt 203. A toner band at the start of the image forming processing is significantly reduced as compared with a toner band at the completion of the image forming processing by carrying out the controlling procedure described below.

As shown in FIG. 3, the developing device at the completion of the image forming processing is stopped before the band-shaped toner image formed portion on the photoreceptor passes the developing device (developing nip) by a developing device driving signal. The band-shaped toner image at this time is formed by toner at a fixed developing nip portion, and a toner amount at the developing nip portion becomes small as compared with other parts. The developing device controlling unit 102 turns on operation of drive of the developing device at the time the next printing operation is started after the band-shaped toner image formed portion on the photoreceptor at the start of the image forming processing passes the developing device (developing nip). That is, the band-shaped toner image at the start of the next printing is formed again with the developing nip which formed the band-shaped toner image at the termination of the previous printing operation. Therefore, the toner amount of the band-shaped toner image at the start of the printing can be made smaller than the toner amount of the band-shaped toner image at the stoppage of the printing.

FIG. 6(4) shows a state in the printing operation. An image to be formed on a sheet of paper is written in a timing not overlapping the band-shaped toner image formed at the start of the image forming processing. A state at the termination of the image forming processing is such that, as shown in FIG. 6(5), the photoreceptors 201Y, 201M, and 201C are separated from the intermediate transfer belt 203 and the K photoreceptor is made to abut the intermediate transfer belt 203 by the abutting and separation controlling unit 101. As to the photoreceptors 201Y, 201M, and 201C, the band-shaped toner image formed at the completion of the image processing is made to pass the primary transfer roller position after the photoreceptors and the intermediate transfer belt 203 are separated. The photoreceptor 201K transfers the band-shaped toner image at the completion of the image forming processing to the intermediate transfer belt 203. The band-shaped toner image transferred on the intermediate transfer belt 203 is stopped at a position in front of the transfer roller 205 (secondary transfer position P2) as shown in FIG. 6(6). The abutting and separation controlling unit 101 also keeps the transfer roller 205 separated at stoppage of the intermediate transfer belt 203. At the imaging forming processing of a next time, the abutting and separation controlling unit 101 makes the transfer roller 205 abut the transfer belt 203 after the toner band on the transfer belt 203 passes the secondary transfer position P2.

By carrying out the operation described above, a stain of an image due to the band-shaped toner image at the start and at the completion of the image forming processing can be prevented. In addition, as to the band-shaped toner image formed on the photoreceptor at the start of the image forming processing, since the transfer roller 205 does not need to be separated from the transfer belt 203 at the start of the image forming processing, time required from the start of the printing operation to the termination of the printing can be shortened.

In the image forming device having a configuration of applying a predetermined potential difference and superposingly applying a periodically changing voltage to the photosensitive surface as a developing high voltage, as shown in FIG. 3, when a band-shaped toner image formed portion on the photoreceptor (a region of the second region excluding the first region on the photosensitive surface) at activation and stoppage passes the developing device (developing nip), the voltage controlling unit 103 stops the application of the periodically changing voltage to reduce an amount of generation of the band-shaped toner image.

Figure 7:
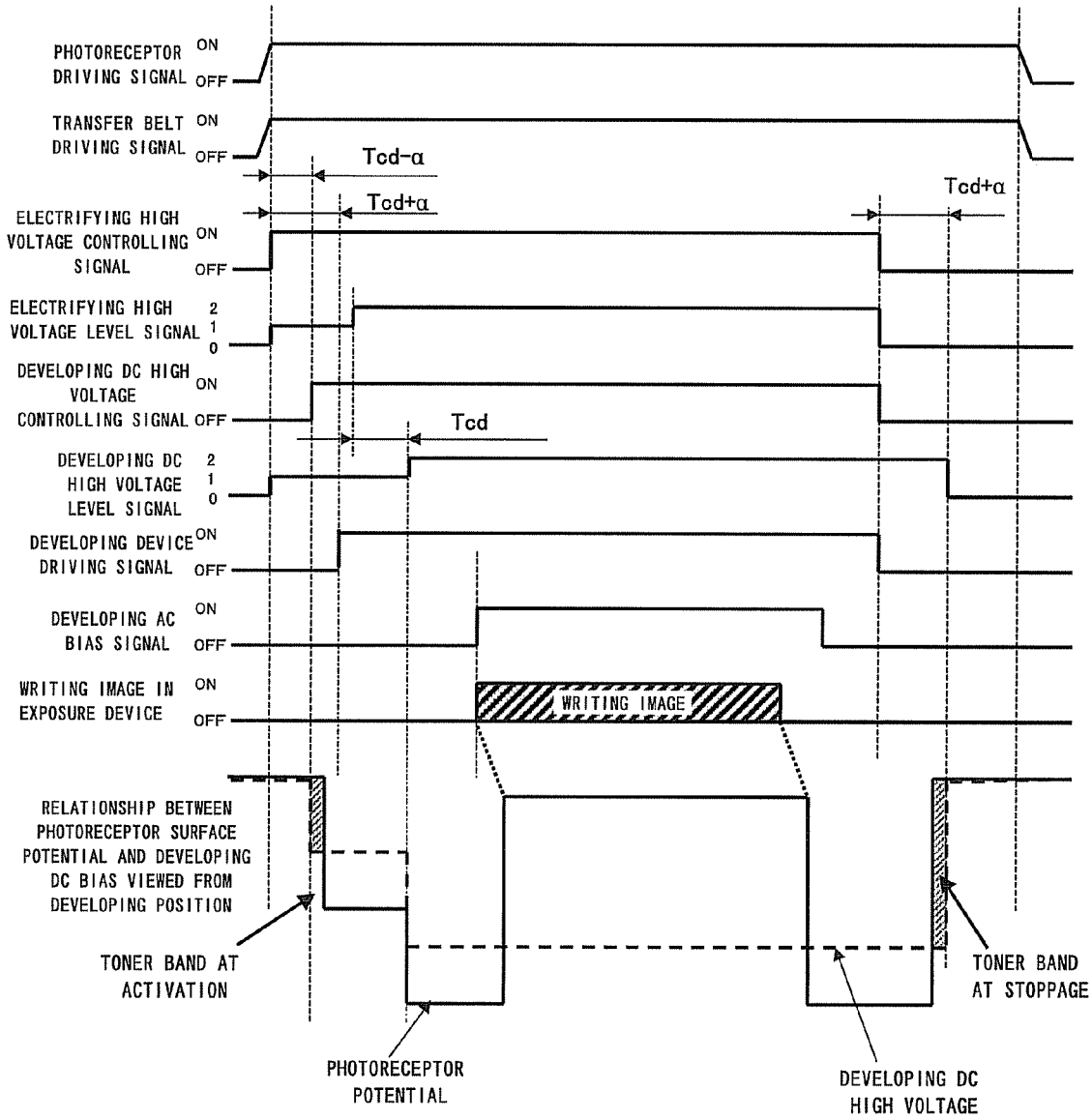
FIG. 7 is a timing chart showing an on/off timing of a drive signal and a control signal in the image forming device M according to the third embodiment of the present invention.
Figure 8:
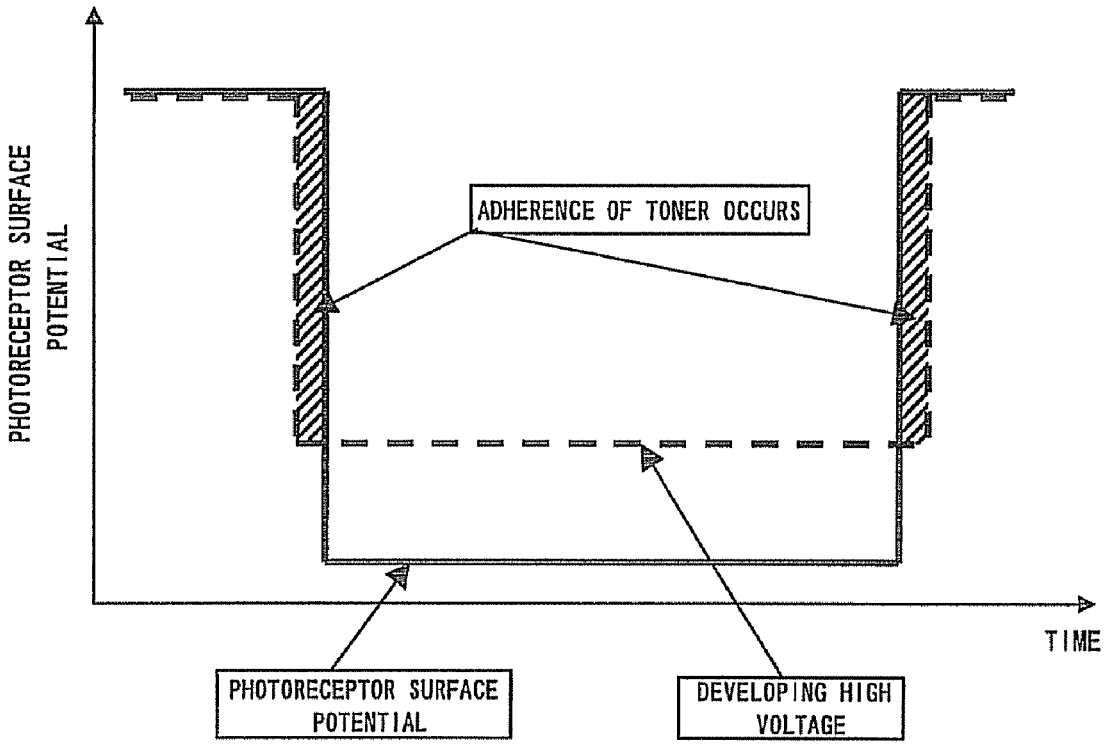
FIG. 8 is a view showing a temporal change of a potential of a surface of a photoreceptor and a potential applied by a developing device viewed from a developing position at the time of image forming in a conventional image forming device.

In addition, as shown in FIG. 7, an absolute value of an electrifying high voltage influencing a potential of a photoreceptor surface (absolute value of a potential difference of the photosensitive surface electrified by the charger) and an absolute value of a direct-current component of the developing high voltage (absolute value of a potential difference applied to the photosensitive surface by the developing device) are made to have a condition different from a potential condition of the printing operation (potential difference between the transfer roller and the intermediate transfer belt at operation of transferring of the two-component developer to a sheet of paper carried out by the transfer roller). Thereby, there is an advantageous effect that a development field of the toner band portion generated at activation is made to be small. In an example shown in FIG. 7, only at the start of the image forming processing is included in the above condition. However, a similar control may be carried out at the completion of the image forming processing.

When the band-shaped toner image formed on the photosensitive surface at the start of the image forming processing passes the transfer roller 205, constant current which is in the opposite of paper transfer polarity and is an absolute value set to be smaller than a paper transfer high voltage (potential difference between the transfer roller and the intermediate transfer belt at operation of transferring of the two-component developer to a sheet of paper carried out by the transfer roller) is preferably applied to the transfer roller 205. This is because, when low current applied to the transfer roller is in the same polarity as the paper transfer polarity or equivalent to or higher than the transferring high voltage in an absolute value, a state which is disadvantageous with respect to a stain on an image (margin is small) is obtained.

In addition, after applying a high voltage, constant current in the same polarity as the paper transfer and substantially equivalent to the paper transfer high voltage is more preferably applied in a timing before the transferring on paper for 1 cycles or more of the secondary transfer roller 205. Toner adhered to a surface of the transfer roller can effectively be removed by applying the constant current of polarity to the secondary transfer roller 205 before the transferring on paper. Thereby, a stain on a rear surface of an image can be prevented.

In the image forming device which applies certain constant current to the secondary transfer roller 205 and monitors a voltage at that time to determine a voltage condition at the time of transferring on paper, time required from the start of the printing operation to the termination of the printing can be made to be short by applying constant current substantially equivalent to the high voltage for transferring on paper (transfer bias) and using the voltage monitor in common.

In both FIGS. 3 and 7, an example of developing device drive OFF in sync with electrification processing controlling signal OFF is described. However, the developing device drive OFF may be carried out before the electrification processing controlling signal OFF. For example, in a case of a configuration where the toner supplying operation is carried out after the termination of the printing, unnecessary agitation of developer can be prevented by carrying out the developing device drive OFF in a timing of the termination of the toner supplying, and thereby deterioration of the developer can be restricted.

The present invention has been described in detail by specific embodiments. However, it is obvious to those skilled in the art that a variety of changes and modifications can be made without departing from the spirit and the scope of the present invention.

As has been described in detail so far, according to the present invention, a technique capable of preventing deterioration of image quality resulting from the band-shaped toner image created on the photosensitive surface in order to prevent the so-called carrier attraction can be provided.

What is claimed is:

1. An image forming method comprising:

an abutting and separation step that allows a first image carrier and a second image carrier to abut on an intermediate transfer body to form an image and thereafter that allows only the second image carrier to abut on the intermediate transfer body by separating the first image carrier from the intermediate transfer body; and then a collecting step that collects a toner band on the first image carrier in situ to conduct new image formation.

2. The method according to claim 1, wherein in the abutting and separation step, only the second image carrier abuts on the intermediate transfer body by separating the first image carrier from the intermediate transfer body.

3. The method according to claim 2, wherein the first image carrier abuts on the intermediate transfer body to conduct the image formation after passing the toner band on the first image carrier between the first image carrier and the intermediate transfer body.

4. The method according to claim 1, wherein the first image carrier abuts on the intermediate transfer body to conduct the image formation after passing the toner band on the first image carrier between the transfer members and the intermediate transfer body.

5. The method according to claim 1, wherein the toner band is a band-shaped toner image created on the first image carrier in order to prevent carrier attraction.

6. A toner band removing method for an image forming apparatus comprising:

abutting a first image carrier and a second image carrier onto a transfer body to form an image;

separating the first image carrier from the transfer body while keeping the second image carrier abutted onto the transfer body;

collecting the toner band on the first image carrier; and abutting the first image carrier onto the transfer body again.

7. The method according to claim 6, wherein the toner band is a band-shaped toner image created on the first image carrier in order to prevent carrier attraction.

8. A toner band removing method for an image forming apparatus comprising:

abutting a first image carrier and a second image carrier onto an intermediate transfer body to form an image;

separating the first image carrier from the intermediate transfer body while keeping the second image carrier abutted onto the intermediate transfer body;

transferring the toner band on the second image carrier on to the intermediate transfer body with a primary transfer body;

collecting the toner band transferred onto the intermediate transfer body; and abutting the first image carrier onto the intermediate transfer body again.

9. The method according to claim 8, wherein the toner band is a band-shaped toner image created on the first image carrier in order to prevent carrier attraction.

* * * * *